US005096450A

United States Patent [19]

Sugimura et al.

[11] Patent Number: 5,096,450

[45] Date of Patent: Mar. 17, 1992

[54] METHOD FOR FABRICATING AN IMPREGNATED TYPE CATHODE

[75] Inventors: Toshikazu Sugimura; Yoshio Takeshima; Hidefumi Yamamoto; Masaaki Yabuta; Masami Horiuchi, all of Shiga, Japan

[73] Assignee: NEC Kansai, Ltd., Shiga, Japan

[21] Appl. No.: 679,170

[22] Filed: Mar. 26, 1991

Related U.S. Application Data

[63] Continuation-in-part of Ser. No. 555,238, Jul. 19, 1990, abandoned.

[30] Foreign Application Priority Data

Jul. 21, 1989 [JP] Japan ..... 1-189131

[51] Int. Cl.[5] ..... H01J 9/04

[52] U.S. Cl. ..... 445/50; 445/51; 419/19; 419/49

[58] Field of Search ..... 445/50, 51, 36; 313/346 DC, 346 R; 419/49, 19; 264/104, 61

[56] References Cited

U.S. PATENT DOCUMENTS 3,148,056 9/1964 Brodie et al. ..... 445/51 X
3,525,135 8/1970 Bondley ..... 445/51
3,684,912 8/1972 Cheney et al. ..... 313/346 R
3,842,309 10/1974 Van Stratum et al. ..... 313/346 DC
3,986,799 6/1961 Levi et al. ..... 445/50
4,081,272 3/1978 Adlerborn ..... 419/49
4,117,367 9/1978 de Bri et al. ..... 445/50 X
4,578,626 10/1984 Moritoki et al. ..... 65/59.5
4,823,044 4/1989 Falce ..... 313/346 DC

*Primary Examiner*—Kenneth J. Ramsey
*Attorney, Agent, or Firm*—Laff, Whitesel, Conte & Saret

[57] ABSTRACT

A method for fabricating an impregnated type cathode comprises the steps of mixing metal powder having a high melting point and a heat proof property, and electron emission substance powder in a dry state, pressing the mixed powder to provide a pressed mixture, and applying an isostatic pressure to the pressed mixture contained in a sealed capsule. At the mixing stage, the metal powder is heated by a high temperature lower than the melting point, and at the mixing stage, a sintered mixture is obtained. In this method, the steps are simplified and decreased in number to decrease a fabricating cost. Furthermore, no influence occurs in electron emission due to hydrooxides.

5 Claims, 3 Drawing Sheets

METHOD FOR FABRICATING AN IMPREGNATED TYPE CATHODE

This application is a continuation-in-part of application Ser. No. 07/555,238, filed July 19, 1990, now abandoned.

FIELD OF THE INVENTION

This invention relates to a method for fabricating an impregnated type cathode, and more particularly to, a method for fabricating an impregnated type cathode having a long life of electron emission and a stable current flowing property.

BACKGROUND OF THE INVENTION

An impregnated type cathode has been proposed to improve electric conduction of an oxide cathode. In this impregnated type cathode, the so-called impregnated dispenser cathode having a porous tungsten which is impregnated with electron emission substance has been dominant in this field. This impregnated dispenser cathode has been described, for instance, in the U.S. Pat. Nos. 4,165,473 and 3,358,178.

However, a method for fabricating an impregnated dispenser cathode has disadvantages in that steps are complicated, and a time of each step is long, so that a fabricating cost is increased. In addition, it has a disadvantage in that electron emission is badly affected by hydrooxides of metals in an emitter composed of barium oxide (BaO) calcium oxide (CaO) alumina ($Al_2O_3$), etc., because such oxides are easily changed into hydrooxide in atmosphere during assembly process. The hydrooxides melt and cover a surface of the cathode at evacuating stage at a low temperature of several 100° C.

SUMMARY OF THE INVENTION

Accordingly, it is an object of this invention to provide a method for fabricating an impregnated type cathode, by which an impregnated type electrode is obtained with a low fabricating cost.

It is another object of this invention to provide a method for fabricating an impregnated type cathode, in which no hydrooxide is produced to provide a long life of electron emission and a stable current flowing property.

According to this invention, a method for fabricating an impregnated type cathode, comprises the steps of:

mixing metal powder having a high melting point and a heat proof property, and electron emission substance powder to provide mixed powder in a dry state, the metal powder being heated by a high temperature lower than the melting point;

pressing the mixed powder to provide a pressed mixture;

introducing the pressed mixture into a capsule to be then sealed; and applying an isostatic pressure to the pressed mixture contained in the sealed capsule at a high temperature of 1000° to 1300° C. to provide a sintered mixture.

BRIEF DESCRIPTION OF THE DRAWINGS

This invention will be explained in more detail in conjunction with appended drawings, wherein.

DESCRIPTION OF THE PREFERRED EMBODIMENT

Before explaining a method for fabricating an impregnated type cathode in the preferred embodiment, a conventional method for fabricating an impregnated dispenser cathode will be explained in FIG. 1.

At first, tungster powder having an averaged particle diameter of several ion is pressed to provide a rod shaped tungsten (STEP 1), and the rod shaped tungsten is sintered in the atmosphere of hydrogen at a temperature of 2500° C. (STEP 2). In the steps 1 and 2, a particle degree of the tungsten powder, a pressure, a sintering temperature, etc. are adjusted to provide a porous sintered product which is well controlled in quality. Next, the porous rod shaped tungsten is buried to be heated by copper poweder, so that the porous rod shaped tungsten is mechanically strengthened by the penetration of copper thereinto (STEP 3). Then the strengthened rod shaped tungsten is processed to be a predetermined configuration of pellets (STEP 4), and the penetrated copper is molten out of the rod shaped tungsten by heating it in a vacuum state (STEP 5). Thereafter, electron emission substance which is defined to be an emitter obtained in the form of a mixture including barium carbonate ($BaCO_3$), calcium carbonate ($CaCO_3$), alumina ($Al_2O_3$), etc. by an appropriate mole ratio is heated to be impregnated into pores of the pellet in the atmosphere of hydrogen at a temperature of 1600° to 1700° C. (STEP 6). Finally, brushing, polishing, and cleaning are carried out to remove surplus emitter adhered on the surface of the pellet (STEP 7). Thus, the completed pellets are transferred to a following stage for assembling an impregnated dispenser cathode.

As apparent from the process described above, each step is complicated, and it takes a long time in each step, so that a fabricating cost is increased. In addition, the emitter composed of barium carbonate ($BaCO_3$), calcium carbonate ($CaCO_3$), alumina ($Al_2O_3$), etc. is molten to be impregnated into the porous tungsten pellet at a temperature of 1600° to 1700° C. at the step 6, so that the above carbonates are resolved to produce oxides such as BaO and CaO, and compounds, which are liable to react with water component in the air atmosphere to produce barium hydrooxide such as $Ba(OH)_2$. This hydrooxide is molten to cover the surface of the cathode at a low temperature of several 100° C., so that electron emission is badly affected, as described before. This is a reason why the above described disadvantages occur in the conventional method for fabricating an impregnated dispenser cathode.

Next, a method for fabricating an impregnated type cathode in the preferred embodiment according to the invention will be explained in FIGS. 2 to 5.

Figure 3:
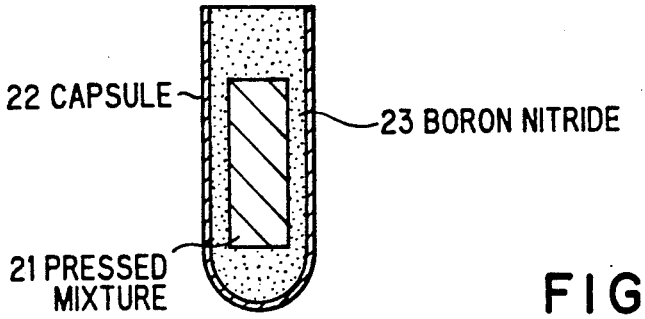
FIG. 3 is a schematic cross sectional view showing a pressed mixture of particles contained in a capsule at a step of the method in the preferred embodiment.
Figure 4:
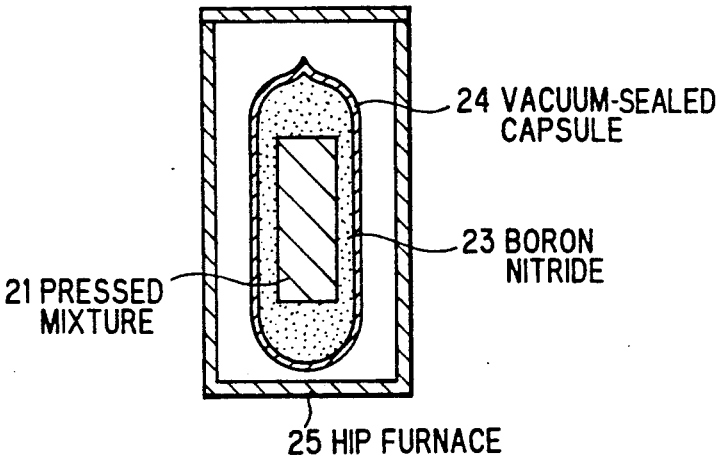
FIG. 4 is a schematic cross sectional view showing the capsule positioned in an HIP treating furnace.
Figure 5:
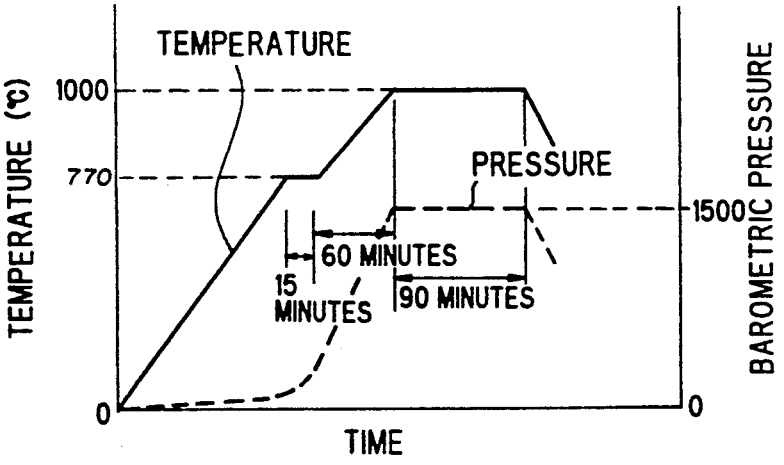
FIG. 5 is a graph showing a condition of temperature and pressure in the HIP treating furnace.

At first $BaCO_3$, $CaCO_3$, and $Al_2O_3$ which are mixed with a mole ratio of 4:1:1 are heated in air at a temperature of 1100° C. for 30 hours (STEP 10*a*). The carbonate is resolved to become oxide, so that an oxide mixture including a main component of barium aluminate results therefrom. The above baking condition may be changed as, for instance, a temperature of 1300° C. for one hour, that is, an increased temperature and a reduced time. Next, the oxide is crushed by ball milling (STEP 10*b*), and mixed with tungsten powder having a particle diameter of approximately 2 to 10 μm (STEPS 10*c* and 10*d*). The oxide (electron emission material) is mixed by a weight ratio of 2 to 10% relative to the tungsten. This mixing ratio is practically preferable to be 4 to 8%, approximately. Although as this mixing ratio becomes smaller, the mechanicla strength becomes greater after an HIP treatment, which is explained later. It is difficult to provide electron emission when the mixing ratio is too small, and the mixed powder is pressed in a dry and cold state under a pressure of approximately 1 ton/cm$^2$ to provide a cylindrical pressed mixture (STEP 11). This cylindrical pressed mixture 21 is contained in a capsule 22 which is filled with boron nitride (BN) 23 as shown in FIG. 3, and the capsule 22 is sealed to provide a vacuum capsule 24 (STEP 12), and is contained in a Hot Isostatic Press (HIP) treatment furnace 25 as shown in FIG. 4 (STEP 13). In this HIP treatment furnace 25, an isostatic pressure is applied in an atmosphere of argon gas to the pressed mixture 21 in accordance with temperature and pressure increasing schedule as shown in FIG. 5. As apparant from FIG. 5, a temperature is increased to 770° C., at which it is maintained for 15 minutes, and is again increased to 1,000° C., at which it is maintained for 90 minutes. During the time of 90 minutes, an increased pressure of 1,500 barometric pressure is maintained along with the maintaining of the temperature of 1,000° C. to carry out a final HIP treatment, so that the pressed mixture 21 becomes a sintered product which is processed to be a predetermined configuration of pellets by a mechanical work (STEP 14). Then, the pellets are subject to a cleaning process for cleaning the surface of the pellets (STEP 15), and are finally transferred to assembling stage of an impregnated dispenser cathode (STEP 16). In order to facilitate an understanding of this invention, Ba (in electron emission material) and tungsten for a cathode substrate member are subject to a following chemical reaction.

Ba is in the form of oxide (BaO) or aluminate (for instance $Ba_3Al_2O_6$, $Ba_5$, $CaAl_4O_{12}$, etc.) in a cathode. These substances become free Ba in accordance with a reduction by reaction with W in operation of an electron tube. A single atom layer of Ba is formed on the surface of the cathode, so that electron emission is obtained form the layer. The reaction which is an established theory is:

$$3\ BaLa_2O_6 + W \rightarrow BaWO_4 + 2\ BaAl_2O_4 + 3\ Ba$$

In operation of the electron tube, Ba in the right term of the above equation evaporates gradually. However, Ba is supplied from the internal by the progress of the above equation in the right direction.

When this reaction is completed, electron emission is not obtained. Therefore, this reaction should not be completed in the process for fabricating a cathode. In this invention, the process includes an HIP method, by which a cathode is fabricated at a temperature as low as 1000° C.

Figure 1:
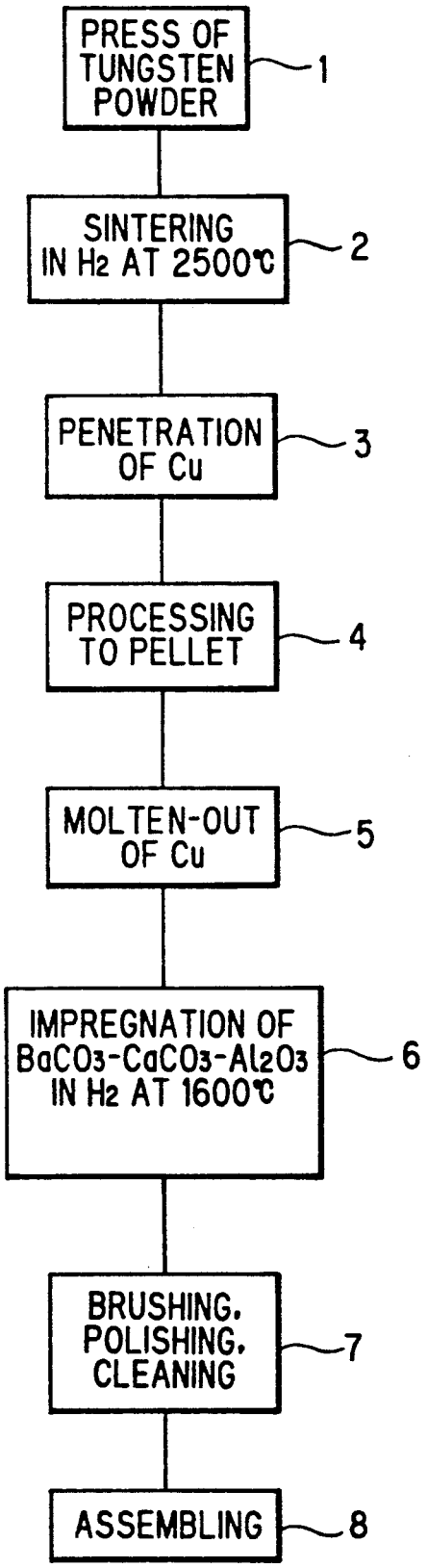
FIG. 1 PRIOR ART
FIG. 1 is a flow chart showing a conventional method for fabricating an impregnated dispenser electrode.
Figure 2:
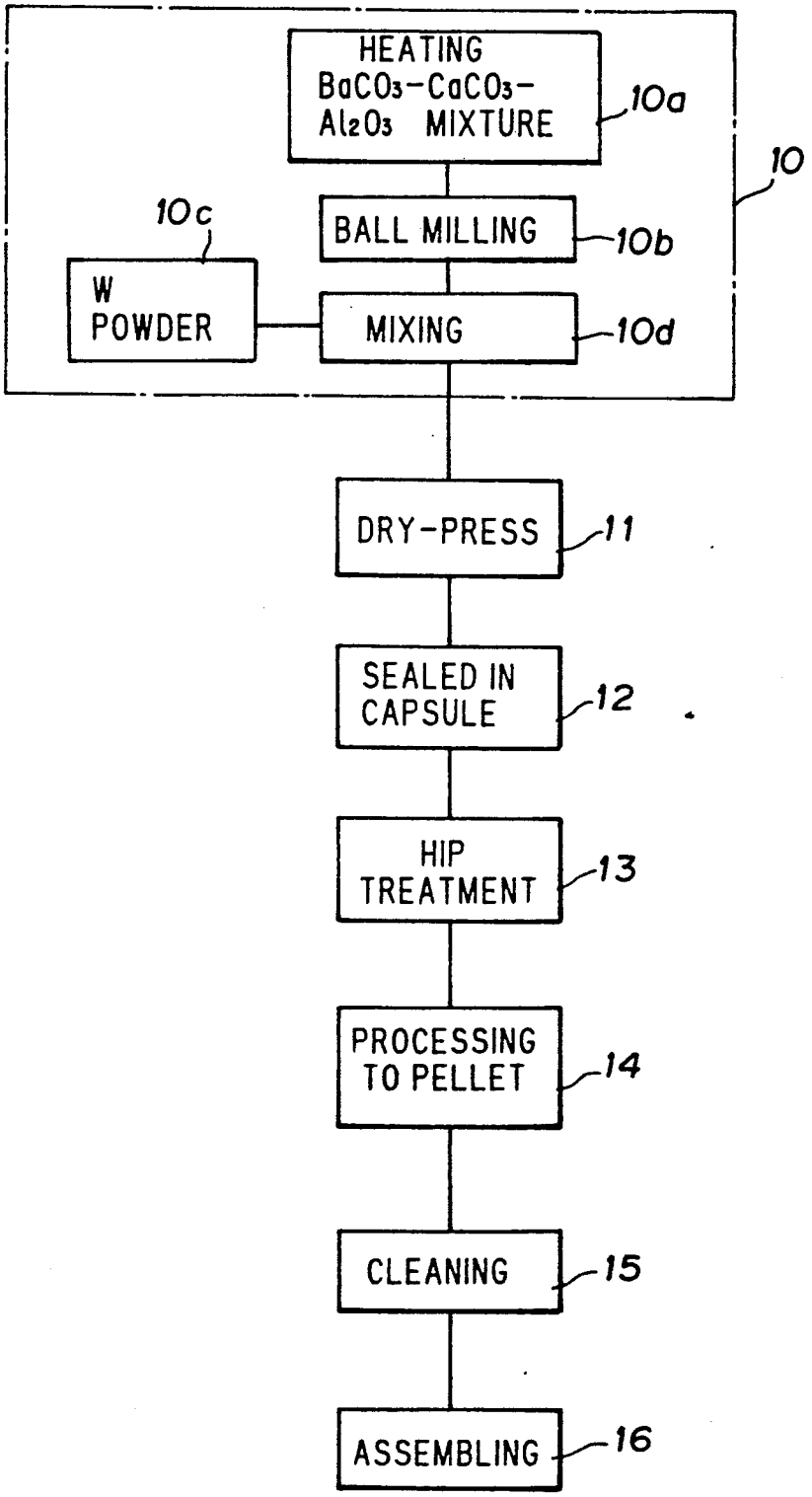
FIG. 2 is a flow chart showing a method for fabricating an impregnated type cathode in a preferred embodiment according to the invention.

On the contrary, a critical and difficult control such as a temperature of 1600° C. to 1800° C. and one to five minutes is required int h conventional process as explained in FIG. 1.

As described above, steps which are complicated and take a long time as seen in a fabrication of a porous tungsten-sintered product, penetration and molten-out of copper, an impregnation of an emitter at a high temperature for a long time by heating, etc. are not necessary to be included in the invention.

Furthermore, a cathode fabricated by the process including an HIP treatment has a density which is proximate to the theoretical density, so that the penetration of water component through voids into the internal is difficult to occur, even if the Ba compound is subject at the surface layer to hydrolysis by absorbing water from air. This is very advantageous in regard to storage.

In the preferred embodiment, carbonates are used as electron emitting substance. But oxide such as $Ba_3Al_2O_6$-CaO, $BaAl_2O_4$-BaO-CaO, BaO-CaO-$Al_2O_3$ and work function reducing additive selected from Ir, Os, Ru, and Sc either alone or in certain combinations can be used successfully. In this case, high density sintering by HIP prevents the invading of moisture, then slow down the bad effect of hydrooxide.

Although the invention has been described with respect to specific embodiment for complete and clear disclosure, the appended claims are no to be thus limited but are to be construed as embodying all modification and alternative constructions that may occur to one skilled in the art which fairly fall within the basic teaching herein set forth.

What is claimed is:

1. A method for fabricating an impregnated type cathode, comprising the steps of:

mixing metal powder having a high melting point and a heat proof property, and electron emission substance powder in a dry state, said metal powder being heated by a high temperature lower than said melting point;

pressing said mixed powder to provide a pressed mixture;

introducing said pressed mixture into a capsule to be then sealed; and applying an isostatic pressure to said pressed mixture contained in said sealed capsule at a high temperature of 1000° to 1300° C. to provide a sintered mixture.

2. A method for fabricating an impregnated type cathode, according to claim 1, wherein:

said step of mixing includes mixing tungsten powder, nickel powder, and mixed powder of barium oxide, calcium oxide, alumina.

3. A method for fabricating an impregnated type cathode, according to claim 1 further comprising the steps of:

processing said pressed. mixture to be a predetermined configuration of pellets by a mechanical work; and cleaning a surface of said pellets.

4. A method for fabricating an impregnated type cathode, according to claim 1, wherein:

said step of mixing includes mixing tungsten powder, less than 3 weight % of oxide powder as sintering agent, and 2 to 70 weight % of oxide powder such as $Ba_3Al_2O_6$-CaO, $BaAl_2O_4$-BaO-CaO and BaO-CaO-$Al_2O_3$, and work function reducing additives selected from Ir, Os, Ru, Sc either alone or in certain combinations.

5. A method for fabricating an impregnated type cathode comprising the steps of:

mixing metal powder havein a high melting point and a heat proof property, and electron emission substance powder in a dry state, said metal powder being heated by a high temperature lower than said melting point;

pressing said mixed powder to provide a pressed mixture;

introducing said pressed mixture into a capsule to be then sealed; and applying an isostatic pressure to said pressed mixture contained in said sealed capsule at a high temperature to provide a sintered mixture, isostatic pressure of 1,500 barometric pressure at a temperature of 1,000° C. for 90 minutes in an atmosphere of argon gas.

* * * * *